United States Patent [19]

Blickle et al.

[11] Patent Number: 4,664,636

[45] Date of Patent: May 12, 1987

[54] ELASTIC MOUNTING FOR A CYCLOIDAL PROPELLER

[75] Inventors: Karl Blickle, Herbrechtingen-Bolheim; Werner Fork, Heidenheim; Hermann Wunder, Eichenau, all of Fed. Rep. of Germany

[73] Assignees: J. M. Voith GmbH; Muller-BBM GmbH, both of Fed. Rep. of Germany

[21] Appl. No.: 648,884

[22] Filed: Sep. 10, 1984

[30] Foreign Application Priority Data

Sep. 10, 1983 [DE] Fed. Rep. of Germany ..... 3332785

[51] Int. Cl.[4] ..... F16D 25/64

[52] U.S. Cl. ..... 440/52; 464/95; 403/225

[58] Field of Search ..... 440/52, 83; 464/94, 464/95, 89, 91, 93, 180; 403/225, 220

[56] References Cited

U.S. PATENT DOCUMENTS

| | | | |
|---|---|---|---|
| 1,373,082 | 3/1921 | Laycock | 464/95 |
| 1,580,747 | 4/1926 | MacDonald | 464/95 |
| 2,538,499 | 1/1951 | Benoit | 464/95 |
| 4,493,662 | 1/1985 | Taguchi | 440/83 |

FOREIGN PATENT DOCUMENTS

| | | | |
|---|---|---|---|
| 2044372 | 10/1980 | United Kingdom | 440/83 |

OTHER PUBLICATIONS

W. Baer, "Norddeutscher-Lloyd-Schlepper 'Stier'", *Schiff und Hafen*, vol. 7, (Jul. 1954), pp. 414–418.

Dubbel, "Taschenbuch für den Maschinenbau", p. 535, FIG. 127.

"Hütte," 1954, p. 128, FIGS. 32 and 34.

Voith, *Cycloidal Propulsion*, 1959, (6 pages).

Voith, *Voith-Schneider Propulsion*, pp. 1–8.

"*Schiff und Hafen*", vol. 4, 1969, p. 244, entitled Schallisolierung und elastische Lagerung von Querstrahlaggregaten.

"*Hansa*", p. 1207, 1950, entitled Bereisungsboot 'Karl Jarres' der Duisburg-Ruhrorter Häfen A.G.

*Primary Examiner*—Joseph F. Peters, Jr.

*Assistant Examiner*—L. T. Bartz

*Attorney, Agent, or Firm*—Ostrolenk, Faber, Gerb & Soffen

[57] ABSTRACT

An arrangement for mounting a cycloidal propeller is disclosed which has elastic support rings and elastic thrust rings. At least the elastic thrust rings are clamped between two frustoconical surfaces which are substantially parallel to each other. One surface is on a ring attached to the propeller base plate and the other is on a ring attached to the propeller foundation. The position of the rings may be changed to adjust the natural frequency of the mounting, for better damping of the forces from the propeller. The elastic support rings are preferably also clamped between parallel frustoconical surfaces. The angle of inclination of all the frustoconical surfaces in relation to the plane of the propeller base plate is between 32°–38°.

19 Claims, 3 Drawing Figures

ELASTIC MOUNTING FOR A CYCLOIDAL PROPELLER

BACKGROUND OF THE INVENTION

1. Field of the Invention

The invention relates to the mounting of a cycloidal propeller on a ship's hull. More specifically, the invention relates to a mounting including elastic support rings and elastic thrust rings.

2. Description of the Prior Art

A cycloidal propeller for a ship may have an axis of rotation of its propeller shaft which is generally perpendicular to the direction of advance. Such a propeller conventionally includes a lower annular housing plate or base plate, by which it is mounted on the propeller foundation formed in the ship's hull.

An elastic mounting of a ship's propeller for such a transverse-thrust device is disclosed in "Schiff und Hafen", 1969, pp. 250–251.

One such propeller is disclosed in an article by Friedrich Richter, "Bereisungsboot Karl Jarres der Duisburg-Ruhrorter Häfen AG." ("The Inspection Boat Karl Jarres of the Duisburg-Ruhrorter Häfen AG"), reprinted in HANSA, Zentralorgan für Schifffahrt, Schiffbau, Hafen (Issue No. 37, 1950), which is identical in content to Voith reprint No. 1187, issued in 1953. The mounting of such a propeller is difficult to tune precisely with respect to the resonance frequencies of the drive. Furthermore, such a mounting must be quite stable to avoid damage to elastically resilient elements of the mounting, which would cause problems including impaired damping. Even with a stable mounting, however, operational failures are possible.

The known mounting is disadvantageous because of the difficulty in tuning and the difficulty in replacing a damaged elastic element.

SUMMARY OF THE INVENTION

One object of the present invention is to provide an elastic mounting for a cycloidal propeller which can be manufactured without great expense, which can be easily repaired and which can be easily and accurately tuned. Another specific object of the invention is to provide an elastic mounting whose tuning can be adjusted. The word "elastic" is used herein to refer to any elastically resilient material, such as rubber, which is suitable for use in such a mounting.

These and other objects are achieved by a mounting for a propeller which has elastic thrust rings clamped between two substantially parallel frustoconical support surfaces, referred to as the upper support surfaces. One of the upper support surfaces is defined on a first support means on the ship's propeller foundation for supporting the ship's propeller. The second upper support surface is defined on a second support means on the propeller base plate for supporting the propeller. The two upper support surfaces are frustoconical and substantially parallel to each other. The mounting also includes elastic support rings clamped between first and second lower support surfaces on the respective first and second support means.

The lower support surfaces may also be frustoconical and substantially parallel. The generatrices of the upper and lower support surfaces may intersect the plane of the base plate at equal and opposite angles, and may be inclined from the axis of rotation of the propeller by between 52° and 58°.

The first support means may include an annular thrust ring with the upper support surface defined on it, and the thrust ring may be radially guided inside an annular support member. The first support means may also include adjustment means, such as a screw, for adjusting the axial position of the thrust ring relative to the support member. This adjustment permits the natural frequency of the mounting to be tuned.

With the mounting of the invention, if an elastic ring is damaged, it is not necessary to replace all of the elastic rings. Only the damaged ring must be replaced. Furthermore, commercial elastic rings, such as a length of rubber coil, could be used. Suitable lengths can be cut from a rubber coil and the pieces may then be cemented together at the joints to form rings.

Other objects, features and advantages of the invention will be apparent from the following description, together with the accompanying drawings and the appended claims.

BRIEF DESCRIPTION OF THE DRAWINGS

The invention will be explained below with reference to the drawings in which.

DETAILED DESCRIPTION OF THE PREFERRED EMBODIMENTS

Figure 1:
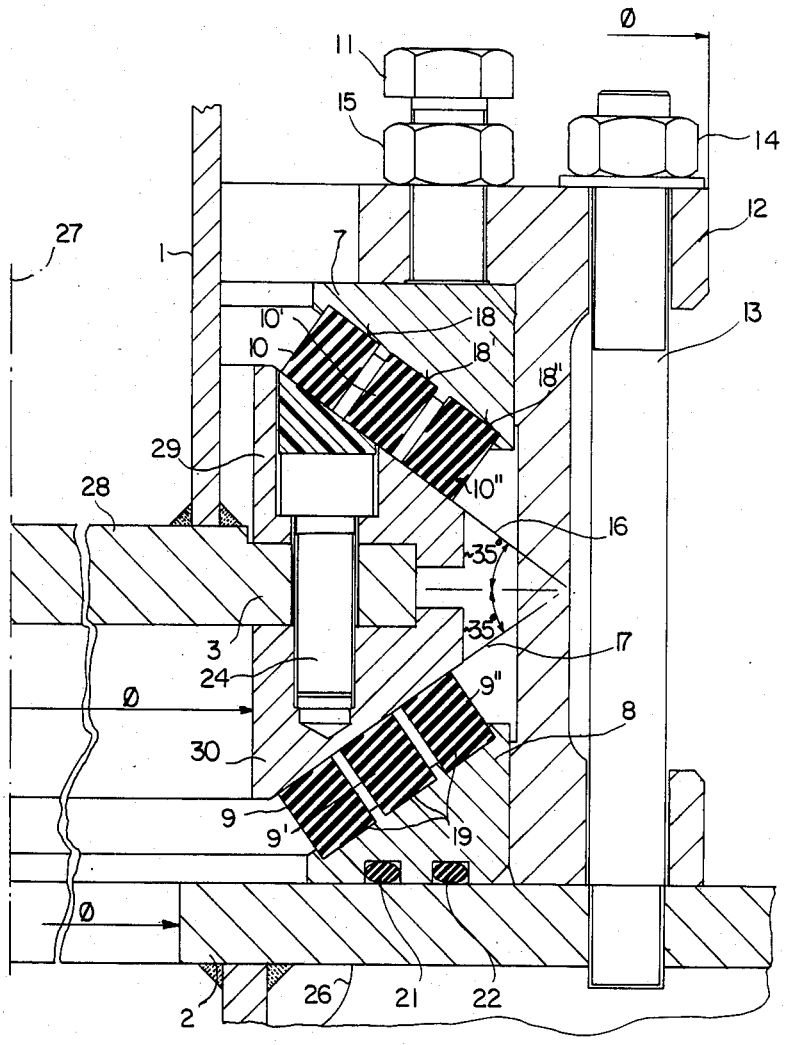
FIG. 1 is an axial cross-sectional view of a first embodiment of a propeller mounting according to the invention, taken along the propeller's axis of rotation.

FIG. 1 shows propeller housing 1 and the above-mentioned annular base plate 28 on which it is mounted with the axis of rotation 27 perpendicular to base plate 28. As shown in FIG. 1, the axis of rotation 27 is vertical, and the propeller structure has a vertical orientation and is driven by a vertical shaft or the like. Other details of the construction of the propeller (not shown) are disclosed in the journal "Schiff und Hafen", 1954, at pp. 414–418 and particularly FIG. 8, all of which are incorporated herein by reference. Another such propeller is disclosed in an 8-page brochure entitled "Voith-Schneider Propulsion", published by Voith in 1981 and also incorporated herein by reference.

A cycloidal propeller typically includes several blades (not shown) hanging vertically downward into the water near the periphery of a horizontally oriented rotatable casing (not shown). As the blades rotate with the casing, they are also pivoted in relation to the casing, so that thrust is generated in relation to the water. Since the casing is supported by base plate 28, bearing forces are applied to base plate 28, including forces due to the weight of the propeller and tilting moments due to differences between the thrust on the blades. The bearing forces are conducted downward into the propeller foundation 2 and upward and laterally into an annular support member or thrust ring 12 through the mounting of the invention. The propeller foundation 2 is formed in the ship's bottom, at the lowest part of the ship's hull, and, in FIG. 1, also has reinforcement ribs 26. The annular base plate 28 of the propeller extends generally parallel to the upper surface of foundation 2.

Around the entire periphery of base plate 28 is mounting flange 3 or other appropriate structure for supporting base plate 28 on elastic means such as rings, as discussed below.

FIG. 1 also shows lower elastic rings 9, 9', 9'' and upper elastic rings 10, 10', 10'' on which base plate 28 is supported through clamping rings 29 and 30. These elastic rings are clamped between clamping rings 29 and 30 and thrust rings 7 and 8, each of which has a substantially frustoconical outer surface. Thrust rings 7 and 8 are included in a support means on the propeller foundation 2, which also includes thrust ring 12 as described below, while clamping rings 29 and 30 are included in a second support means for supporting base plate 28. The elastic rings are mounted between substantially parallel frustoconical outer surfaces. Lower elastic rings 9, 9' and 9'' function as elastic support means for receiving the weight of the propeller, while upper elastic rings 10, 10', 10'' function as elastic thrust means for receiving tilting moments.

This arrangement permits the natural frequencies of the mounting to be tuned exactly. For the purpose of tuning, the upper thrust ring 7, which provides an upper support surface for the upper elastic rings 10, 10', 10'', is adjustable axially in relation to thrust ring 12, which functions as a support member for thrust rings 7 and 8, by clamping screws 11. As shown, thrust rings 7 and 8 are radially inward from thrust ring 12 so that they are guided against it as they move in the axial direction. The thrust ring 12 is fastened by stay bolts 13 and nuts 14 to propeller foundation 2. The adjustment of the upper thrust ring 7 is locked by tightening lock nuts 15 against thrust ring 12. An exact adjustment may be readily and accurately obtained by measuring the gap between upper thrust ring 7 and the inner flange of the thrust ring 12. The same arrangement also facilitates replacement of a damaged elastic ring by appropriate loosening and removal of stay bolts 13 and thurst ring 12, for example.

The upper thrust ring 7, like lower thrust ring 8, is guided radially at its outside surface by thrust ring 12. O-ring seals 21 and 22 provide a seal between the lower thrust ring 8 and the propeller foundation 2. Otherwise the sealing of the propeller is effected by the upper and lower elastic rings. Although at least one of the elastic rings must therefore be continuous around each of the upper and lower support planes, the other elastic means may be discontinuous rings or may take other shapes if appropriate.

FIG. 1 shows three parallel elastic rings in each of the upper and lower support planes, but the number and positioning of elastic rings could be varied. In addition, the upper and lower support surfaces may each include two substantially parallel surfaces or two groups of surfaces which are substantially parallel. In FIG. 1, grooves are formed in the outer surfaces of the upper and lower thrust rings 7 and 8 to provide outer surfaces 18, 18', 18'' and 19, 19', 19''. Therefore, the upper elastic rings 10, 10' and 10'' are located between the outer surface 16 of clamping ring 29 and the outer surface 18, 18' and 18'' in the grooves formed on upper thrust ring 7. Outer surfaces 18, 18' and 18'' define a plane which is treated herein as a continuous upper support surface. The same is true for the lower support plane where the elastic rings are clamped between the outer surface 17 of clamping ring 30 and the planar lower support surface defined by outer surfaces 19, 19' and 19'' in the grooves formed on the lower thrust ring 8. The outer surfaces 16 and 17, which provide a second pair of upper and lower support surfaces moving with and mounted on the annular base plate 28, are on separate clamping rings 29 and 30, respectively. Clamping rings 29 and 30 are fastened by screws 24 to the mounting flange 3. This arrangement facilitates the manufacture of the outer surfaces, which are each shaped like a conical frustum.

The axis of rotation 27 of the propeller is also shown in FIG. 1. Although FIG. 1 shows only one cross-sectional view at radial angle $\phi$, the illustrated structure is generally symmetrical about axis 27 so that the various rings shown are centered on axis 27. As noted above, however, the rings may take other forms.

The inclination of the generatrix of each of the frustoconical outer surfaces 16, 17, 18, 18', 18'', 19, 19' and 19'' is, as shown, about 35° at the intersection with the plane of the annular base plate 28. It has been found that the best and simplest tuning of the mounting can be obtained with such an arrangement. In addition, the angle of inclination of at least the upper outer surfaces 16, 18, 18', 18'' permits the transmission of lateral, upward and downward forces from base plate 28 into the mounting, preventing base plate 28 from moving in relation to foundation 2. This angle of inclination of the frustoconical outer surfaces may vary between 32° and 38°, which corresponds to an inclination of between 52° and 58° with respect to the axis of rotation 27. As shown, the generatrix of each of the upper support surfaces 16, 18, 18', 18'' may be inclined at an angle opposite in sign but identical in magnitude to the angle of inclination of lower support surfaces 17, 19, 19', 19''.

Figure 2:
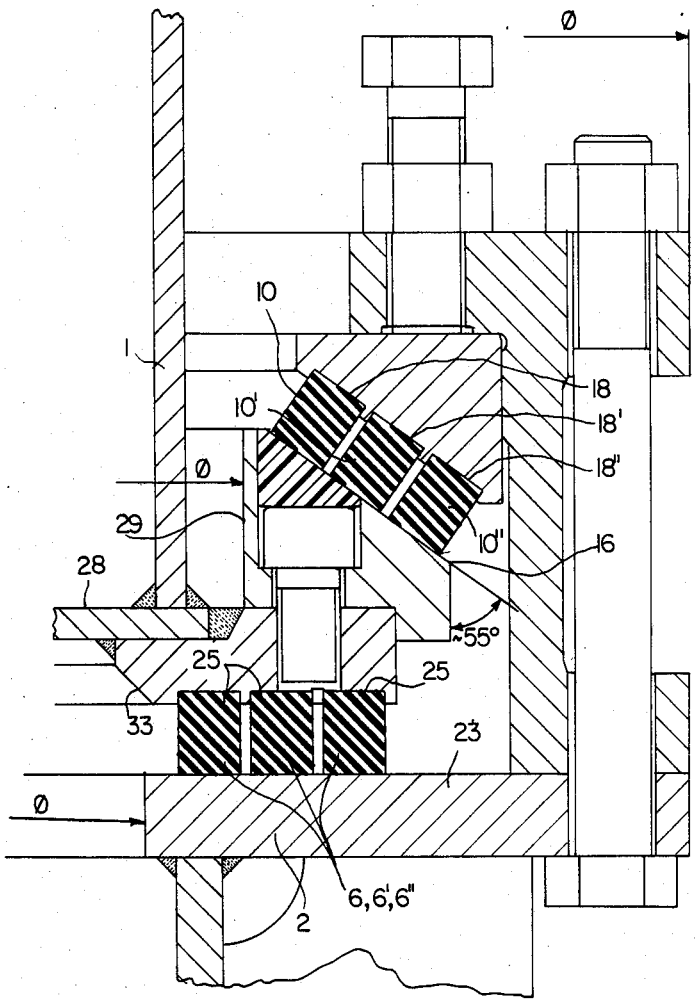
FIG. 2 is an axial cross-sectional view of a second embodiment of a propeller mounting according to the invention.

FIG. 2 differs from FIG. 1 in that the lower elastic rings 6, 6' and 6'' which function to support the weight of the propeller are not clamped between frustoconical surfaces, but rather are clamped between radially extending planar surfaces 23 and 25. Planar surface 25 is defined by grooves formed in lower clamping ring 33. Upper elastic rings 10, 10', 10'' are clamped between frustoconical outer surfaces 16 and 18, 18' and 18''. As shown in FIG. 2, the angle between outer surface 16 and the vertical peripheral side of clamping ring 29 parallel to the axis of rotation is about 55°, so that the angle between outer surface 16 and the plane of the annular base plate 28 is about 35°, as in FIG. 1.

Figure 3:
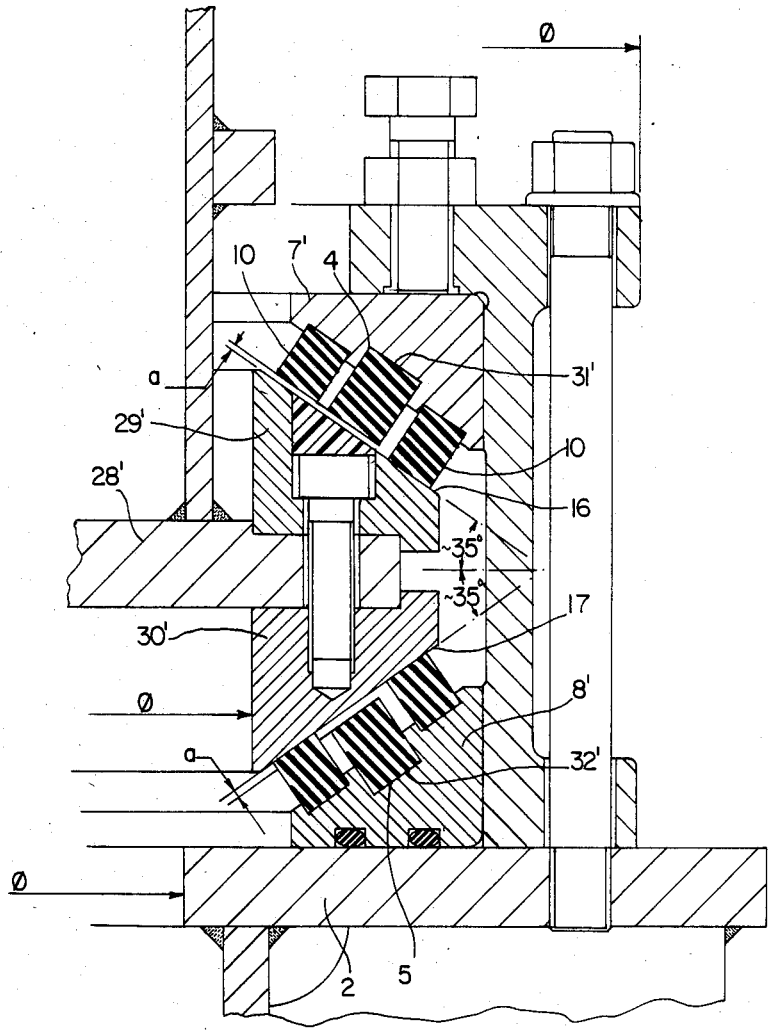
FIG. 3 is an axial cross-sectional view of a third embodiment of a propeller mounting according to the invention.

The arrangement of FIG. 3 corresponds to that of FIG. 1 except that FIG. 3 shows additional elastic support ring 5 between rings 9 and additional elastic thrust ring 4 between rings 10. These additional elastic rings 4 and 5 are clamped in grooves 31' and 32' in the upper thrust ring 7' and the lower thrust ring 8' respectively and will normally have a slight clearance a of between 0.2 and 0.5 mm with respect to the corresponding opposite outer surfaces 16 and 17 of the clamping base rings 29' and 30' on base plate 28' of the propeller housing. Support ring 5 and thrust ring 4 also have a different Shore hardness than the normal elastic rings 9 and 10. If the other elastic rings 9 and 10 have, for instance, a Shore hardness of about 70, then the Shore hardness of rings 4 and 5 is about 90. This arrangement provides a progressive damping or spring action.

In the embodiments shown in FIGS. 1 and 3, the lower elastic rings and the upper rings correspond in pairs to each other with the rings of the upper and lower regions in each pair lying on about the same diameter. This is purely a design choice which facilitates calculation, and this arrangement need not be precisely followed.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. An arrangement for mounting a cycloidal propeller having a vertical axis of rotation on a ship, comprising:

first support means for supporting a propeller on a propeller foundation formed on a hull of a ship, the first support means having upper and lower first support surfaces defined thereon;

a plurality of elastic support rings on the lower first support surface, the elastic support rings being at least in part parallel to each other;

a plurality of elastic thrust rings on the upper first support surface, the elastic thrust rings being at least in part parallel to each other; and second support means for supporting a propeller base plate connected to the propeller on the first support means, the second support means having upper and lower second support surfaces defined thereon for facing the upper and lower first support surfaces respectively and for being clamped respectively against the elastic support rings and the elastic thrust rings; the upper first and second support surfaces each being frustoconical and substantially parallel to each other.

2. The arrangement of claim 1 in which the lower first and second support surfaces are each frustoconical and substantially parallel to each other.

3. The arrangement of claim 2 in which the base plate defines a plane and the upper and lower support surfaces each have a respective generatrix, the generatrices of the upper support surfaces each intersecting the plane defined by the base plate at a first angle, the generatrices of the lower support surfaces each intersecting the plane at a second angle, the first and second angles being opposite in sign.

4. The arrangement of claim 3 in which the first and second angles are approximately the same in magnitude.

5. The arrangement of claim 3 in which the first and second angles are identical in magnitude.

6. The arrangement of claim 3 in which the plane defined by the base plate is perpendicular to an axis of rotation of the propeller, the generatrices of the upper and lower support surfaces each being inclined from the axis of rotation at an angle between 52° and 58° in magnitude.

7. The arrangement of claim 2, further comprising an additional elastic support ring between the lower first and second support surfaces and substantially parallel to the elastic support rings and an additonal elastic thrust ring between the upper first and second support surfaces and substantially parallel to the elastic thrust rings, the additional support and thrust rings being for providing progressive spring action.

8. The arrangement of claim 7 in which the additional elastic support and thrust rings have a different degree of hardness than the elastic support and thrust rings, for providing progressive spring action.

9. The arrangement of claim 2 in which the frustoconical upper first and second support surfaces each have a respective diameter about an axis of rotation of the propeller equal to a respective diameter of the frustoconical lower first and second support surfaces.

10. The arrangement of claim 1 in which the first support means comprises a support member on the propeller foundation, the first support means further comprising a thrust ring having the upper first support surface defined thereon, the thrust ring being disposed radially inward from the support member for being guided axially against the support member, the first support means further comprising adjustment means for adjusting the axial position of the thrust ring relative to the support member.

11. The arrangement of claim 10 in which the adjustment means comprises a screw.

12. An arrangement for mounting a cycloidal propeller having a vertical axis of rotation on a ship, comprising.

first support means for supporting a propeller on a propeller foundation formed on a hull of a ship, the first support means having upper and lower first support surfaces defined thereon;

elastic support means on the lower first support surface;

elastic thrust means on the upper first support surface;

second support means for supporting a propeller base plate connected to the propeller on the first support means, the second support means having upper and lower second support surfaces defined thereon for facing the upper and lower first support surfaces respectively and for being clamped respectively against the elastic support means and the elastic thrust means.

13. The arrangement of claim 12 in which the elastic support means and elastic thrust means each comprise at least one elastic ring.

14. The arrangement of claim 12 in which the upper first and second support surfaces are each frustoconical and substantially parallel to each other.

15. The arrangement of claim 14 in which the lower first and second support surfaces are each frustoconical and substantially parallel to each other.

16. The arrangement of claim 15 in which the base plate defines a plane and the upper and lower support surfaces each have a respective generatrix, the generatrices of the upper support surfaces each intersecting the plane defined by the base plate at a first angle, the generatrices of the lower support surfaces each intersecting the plane at a second angle, the first and second angles being opposite in sign.

17. The arrangement of claim 16 in which the plane defined by the base plate is perpendicular to an axis of rotation of the propeller, the generatrices of the upper and lower support surfaces each being inclined from the axis of rotation at an angle between 52° and 58° in magnitude.

18. The arrangement of claim 12 in which the first support means comprises a support member on the propeller foundation, the first support means further comprising a thrust ring having the upper first support surface defined thereon, the thrust ring being disposed radially inward from the support member for being guided axially against the support member, the first support means further comprising adjustment means for adjusting the axial position of the thrust ring relative to the support member.

19. The arrangement of claim 18 in which the adjustment means comprises a screw.

* * * * *